US010258156B2

(12) United States Patent
DeWeerd et al.

(10) Patent No.: US 10,258,156 B2
(45) **Date of Patent: *Apr. 16, 2019**

(54) LEVELER LEG

(71) Applicant: Haworth, Inc., Holland, MI (US)

(72) Inventors: Jason DeWeerd, Allegan, MI (US); Robert C. Wayner, Holland, MI (US); David Koning, Holland, MI (US); Kristen Glick, Holland, MI (US); Steven J. King, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/618,580

(22) Filed: Jun. 9, 2017

(65) Prior Publication Data

US 2018/0295994 A1 Oct. 18, 2018

Related U.S. Application Data

(63) Continuation-in-part of application No. 15/487,971, filed on Apr. 14, 2017, now abandoned.

(51) Int. Cl.

| | |
|---|---|
| ***E04B 2/82*** | (2006.01) |
| ***A47B 91/16*** | (2006.01) |
| ***E04B 2/74*** | (2006.01) |

(52) U.S. Cl.

CPC ..... *A47B 91/16* (2013.01); *E04B 2/7433* (2013.01); *E04B 2/7438* (2013.01); *E04B 2002/749* (2013.01); *E04B 2002/7446* (2013.01)

(58) Field of Classification Search

CPC ..... A47B 91/024; E04B 2/7405; E04B 2002/749

USPC ..... 52/126.4

See application file for complete search history.

(56) References Cited

U.S. PATENT DOCUMENTS

| | | | | |
|---|---|---|---|---|
| 1,570,576 | A * | 1/1926 | Rivitz | E06C 7/46 182/111 |
| 4,135,690 | A * | 1/1979 | Clarke | E04B 2/7422 248/188.2 |
| 4,193,233 | A | 3/1980 | VandenHoek et al. | |
| 5,274,970 | A * | 1/1994 | Roberts | E04B 2/7409 160/135 |
| 5,690,303 | A * | 11/1997 | Winters | A47B 91/00 248/188.3 |
| 5,913,498 | A * | 6/1999 | Brown | A47B 91/024 248/188.2 |

(Continued)

*Primary Examiner* — Basil S Katcheves

(74) *Attorney, Agent, or Firm* — Warner Norcross + Judd LLP

(57) ABSTRACT

An adjustable panel leg system in a low-profile design includes a foot, an upright leg for supporting an object such as a panel, and an upright adjustment mechanism disposed above the foot and between the foot and the upright leg to enable adjustment of the angle of the upright leg with respect to the foot. The upright adjustment mechanism may include a horizontal pin extending through a portion of the upright leg, such that the upright leg can pivot about the pin with respect to the foot. The upright adjustment mechanism may also include a tubular support extending upwardly from the foot. A portion of the upright leg extends into the opening of the tubular support. The pin extends through the tubular support and the portion of the upright leg such that the leg can pivot within the tubular support.

7 Claims, 9 Drawing Sheets

(56) References Cited

U.S. PATENT DOCUMENTS

| | | | | |
|---|---|---|---|---|
| 8,833,710 | B1 * | 9/2014 | Atkinson | B65F 1/141<br>248/146 |
| 9,414,676 | B1 * | 8/2016 | Rafii | A47B 91/16 |

* cited by examiner

LEVELER LEG

BACKGROUND OF THE INVENTION

The present invention relates to a leveler, and more particularly to a leveler for upright panel systems such as those used in connection with office furniture systems.

Upright office panels are commonly used to divide a larger office spaces into a series of smaller, usable spaces, such as offices, meeting rooms and corridors. Due to inconsistencies and undulations in flooring, these office panels may be provided with a degree of adjustment to keep the panels plumb, especially when the panels are arranged in an elongated straight line.

One adjustment option that is known in the prior art is the threaded glide. As depicted in FIG. 1, in this design, the panel (not shown) is supported by one or more vertical uprights 100, which extends upwardly from a generally horizontal foot 102. A pair of threaded glides 103, 104 extend between the floor 105 and opposite ends of the foot 102. In order to account for the uneven height of the floor surface 105, the glides 103, 104 may be independently adjusted by threading the glides into or out of the foot to vary the distance between the head 106 of the glide 103, 104 and the foot 102. For example, FIG. 1 shows a situation where the glide 104 is threaded into the foot 102 a lesser amount than glide 103 to increase the distance between the head 106 of glide 104 and the foot 102 to account for the uneven surface of the floor 105 and generally maintain the verticality of the upright 100. A downside of this construction is the need for a relatively significant minimum thickness/height of the foot 102 in order to accommodate the threaded glide. In general, enough thickness for at least three threads of the glide 103, 104 are needed in order to provide sufficient adjustability. This thickness can be unsightly, a trip hazard, and can interfere with the positioning of adjacent structures such as desks and storage.

SUMMARY OF THE INVENTION

The present invention provides the advantages of adjustability for a panel system in a low-profile design.

In one embodiment, the present invention includes a foot, an upright leg for supporting an object such as a panel, and an upright adjustment mechanism disposed above the foot and between the foot and the upright leg to enable adjustment of the angle of the upright leg with respect to the foot. In one embodiment, the upright adjustment mechanism includes a generally horizontal pin extending through a portion of the upright leg, such that the upright leg can pivot about the pin with respect to the foot. In a more specific embodiment, the upright adjustment mechanism includes a tubular support extending upwardly from the foot. A portion of the upright leg extends into the opening of the tubular support. The pin extends through the tubular support and the portion of the upright leg such that the leg can pivot within the tubular support. A pair of set screws may extend into opposing sides of the tubular support and into engagement with opposing walls of the lower portion of the upright leg to enable the angle of the upright leg to be set at a desired angle for leveling the panel.

This design enables a low profile foot, because the foot does not need adjustable glides, and the foot does not need a thickness that accommodates for the threads of the glides. These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or may be carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

Figure 1:
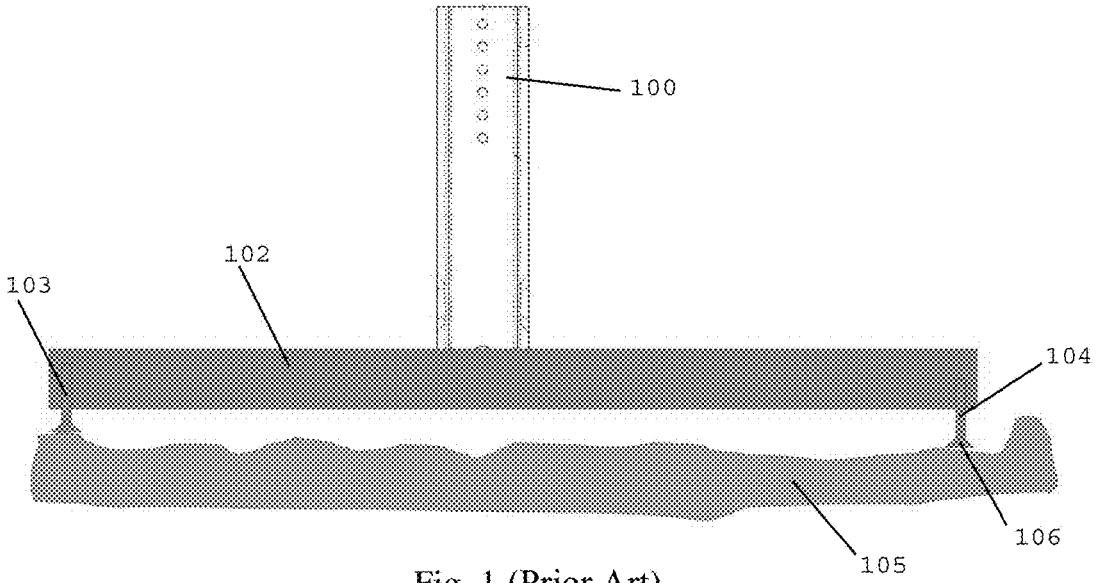
Fig. 1 (Prior Art)
FIG. 1 is a side view of a prior art design.
Figure 2:
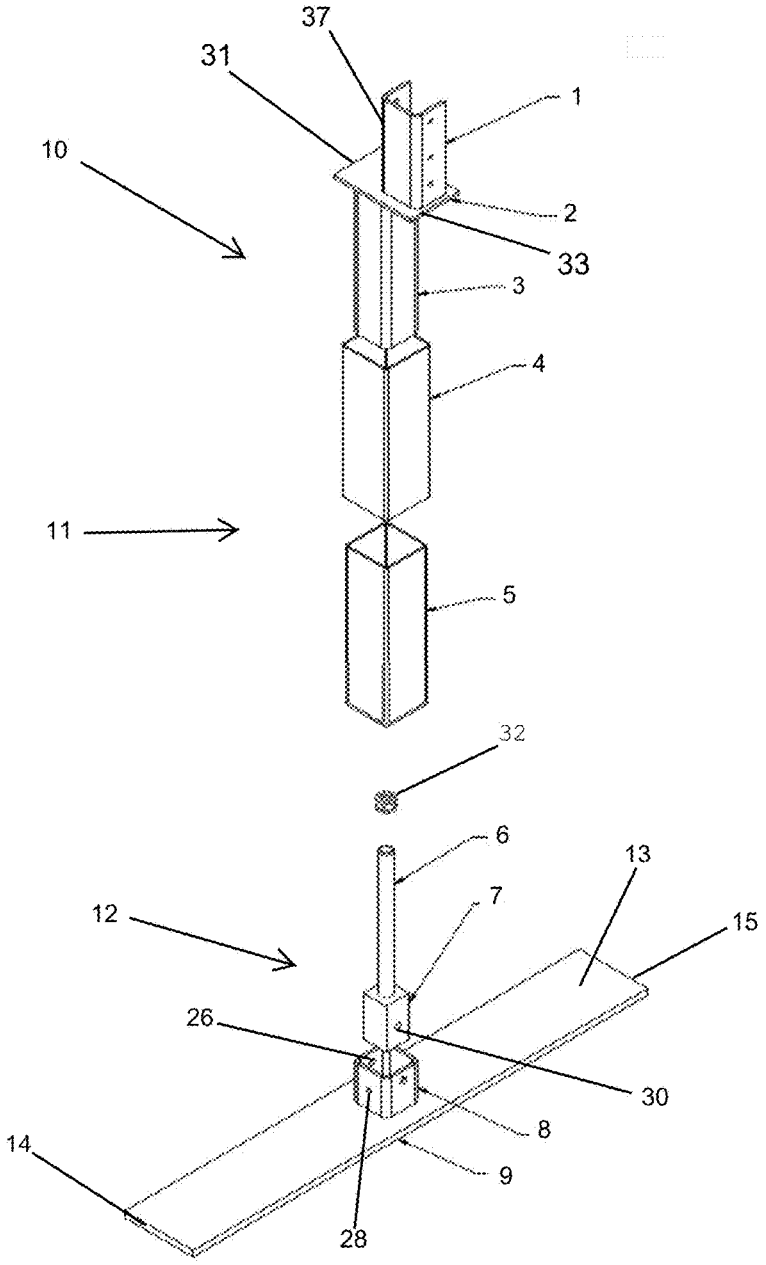
FIG. 2 is a perspective exploded view according to one embodiment of the current design.
Figure 3:
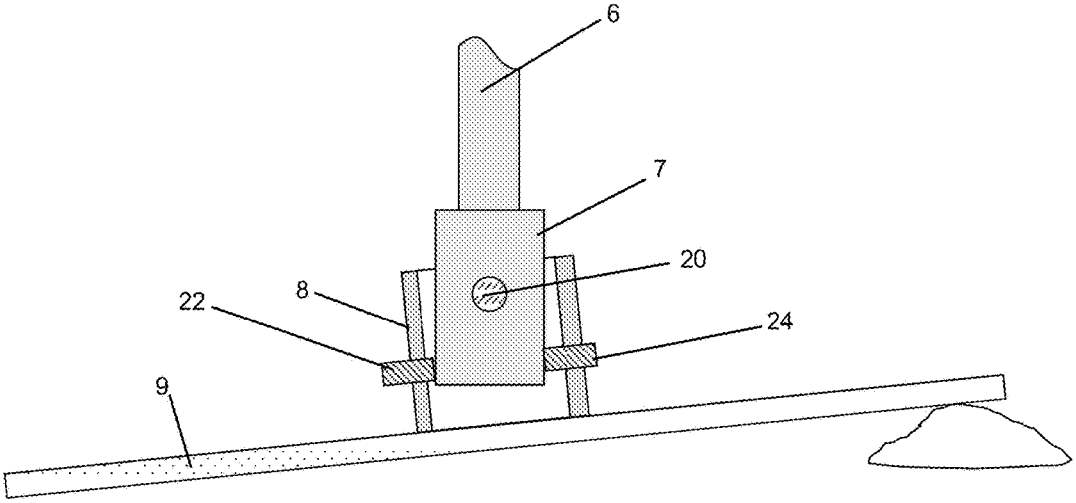
FIG. 3 is a side view according to one embodiment of the current design.

Referring to FIGS. 2-3, a leveler leg is shown and generally designated 10. The leveler leg 10 includes an upright leg assembly 11, a foot 9 and an upright adjustment mechanism 12. The upright adjustment mechanism 12 connects the upright leg assembly 11 to the foot 9 in such a way that the angle of the upright with respect to the foot may be adjusted.

In one embodiment, the foot 9 is a generally low-profile elongated plate having a lower ground engaging surface and an upper surface 13 opposite the ground engaging surface. The foot 9 may include a first end 14 and a second end 15 opposite the first end, such that the foot 9 defines a length between the first 14 and second 15 ends. The length of the foot may be varied from application to application.

The upright assembly 11 includes one or more members extending upwardly from the foot 9. Although not shown, the upper end of the upright assembly may be connected to one of a variety of items for supporting the item. For example, the upper end of the upright assembly 11 may connect to one side of a furniture panel for supporting the furniture panel in an upright position. This furniture panel may be one in a series of furniture panels mounted end to end to form a wall or corridor, wherein each of the screens is supported by an upright assembly 11. In the illustrated embodiment, the upright assembly 11 includes an inner structural leg member 3, a bracket plate 2 and bracket 1 mounted to the inner structural leg member 3, an upper cover 4 and a slidable cover 5. It will be noted that in another, more simplified, embodiment, the upright assembly may include only a single vertical support, such as the structural leg member 3, extending between the adjustment mechanism 12 and the bracket plate 2.

In one embodiment, the upright adjustment mechanism 12 includes a tubular support 8 extending upwardly from the upper surface 13 of the foot 9 and defining an internal opening, an adjustment block 7 extending into the opening of the tubular support 8, a threaded rod 6 extending upwardly from the adjustment block 7, a pivot pin 20, and a setting element, such as a pair of set screws 22, 24. As shown in FIG. 2, the tubular member 8 may include a first set of through holes 26 extending through left and right side surfaces of the tubular member 8, and a second set of through holes 28 extending through front and rear surfaces of the tubular member 8. The adjustment block 7 may also include a through hole 30 extending through the left and right side surfaces. Referring to FIG. 3, the pivot pin 20 extends through the through holes 28 in the tubular member 8 and through the through hole 30 in the adjustment block 7 such that the adjustment block 7 can pivot about the pivot pin 20 with respect to the tubular member 8. More particularly, in the illustrated embodiment, the pivot pin 30 extends perpendicular to the length of the foot 9, such that the adjustment block 7 pivots in the direction of the length of the foot 9. The set screws 22, 24 may extend into the through holes 28 in the front and rear surfaces of the tubular member 8. In this way, the set screws may be adjusted to set the angle of incline of the upright assembly 11 with respect to the foot 9. Depending on the depth of the respective set screws 22, 24, the upright assembly 11 may be set to a desired angle in the direction of either the first end 15 or the second end 14 of the foot 9. In an alternative embodiment, the set screws 22, 24 may be replaced by other structure that can retain the block 7 or the upright assembly 11 in a desired position.

In the illustrated embodiment, the upright assembly also enables height adjustment. In this embodiment, the threaded rod 6 threads into a receiving threaded portion (not shown) which is located in the inner structural tube 3. The threaded rod 6 may be rotated with respect to the structural leg 3 in order to adjust the height of the structural leg 3. A jam nut 32 threads onto the threaded rod 6 to engage the receiving threaded portion in order to prevent the adjustment mechanism from spinning after the desired height is achieved.

The upright assembly may also include one or more covers to enhance the aesthetic appeal of the leveler leg 10. As shown, the upper cover 4 extends over the inner structural leg 3 and abuts the plate 2. The upper cover may be fixed with respect to the structural leg 3. The slidable cover 5 may extend over a portion of the upper cover 4 and over the tubular member 8 to cover and hide the functional aspects of the upright adjustment mechanism 12. The slidable cover 5 may be movable by a user to slide up over the upper cover 4 to expose the tubular member to enable adjustment of the set screws 22, 24 and the upright adjustment mechanism 12.

In operation, the bracket 1 of a leveler leg 10 is mounted to an item, such as an upright modular panel for a furniture panel system or to a privacy screen, by a conventional method. For example, the bracket 1 may be bolted or otherwise attached to a lower portion of a furniture panel. In one embodiment, the bracket 1 of a first leg 10 is bolted to one side of a furniture panel and the bracket 1 of a second leg 10 is bolted to the other side of a furniture panel such that one leg 10 supports the joint of two furniture panels. More particularly, different configurations of bracket 1 may be provided to more efficiently support different furniture panel arrangements. Of course, in an alternative embodiment the leg 1 may include a differently shaped bracket 1 or a different structure altogether for attaching to the furniture panel, and in another embodiment the leg 1 may support a completely different item, such as a worksurface.

The foot 9 of each leg 1 is placed on a floor surface and measured with respect to level. In the event that the foot is not level, or in the event that one end of the foot 9 is not in contact with the floor, the upright leveler mechanism 12 can be manipulated by a user to change the angle of the upright assembly 11 with respect to the foot 9 in order to bring the system to level. In order to do so, the user may lift the slidable cover 5 (to the extent that the product includes the slidable cover 5), and access the set screws 22, 24 to loosen the set screws 22, 24. Once the set screws are loosened, the angle of the foot can be adjusted by pivoting the block 7 about the pivot pin 20 in the direction of the length of the foot 9 (i.e., toward or away from one of the ends 14, 15). The nature of the pivot pin prevents movement of the block 7 or upright assembly 11 in any other direction. The angle of the foot 9 is adjusted until level, and then the set screws 22, 24 are tightened against the block 7 to retain the block 7 in position and thus retain the angle of the upright assembly in the desired level position.

In the event that the leg 10 includes height adjustability, such as the threaded rod 9 of the illustrated embodiment, the height of the upright assembly 11 may be adjusted by manipulating the height adjuster, such as by rotating the threaded rod 6 with respect to the threaded portion in the structural leg 3.

Figure 4:
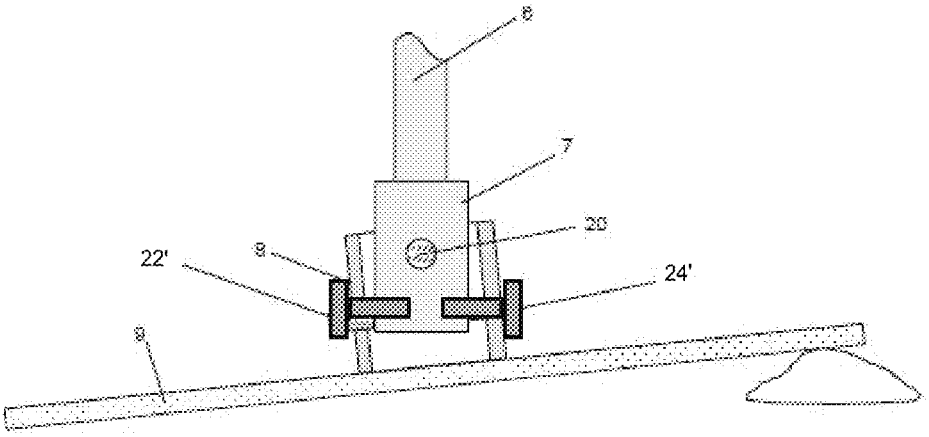
FIG. 4 shows a side view according to an alternative embodiment.
Figure 5:
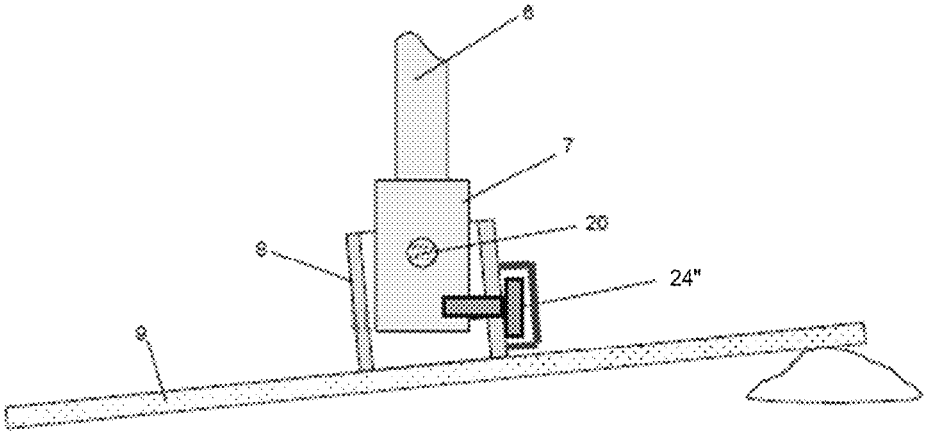
FIG. 5 shows a side view according to a second alternative embodiment.

FIGS. 4 and 5 show alternative embodiments for setting the upright adjustment mechanism at the desired angle. In particular, FIG. 4 shows the set screws 22, 24 replaced by bolts 22', 24'. The bolts 22', 24' may thread into and out of the block 7 for setting the angle of the upright assembly 11, rather than simply abutting the outer surface of the block 7 in the manner of the set screws 22, 24. FIG. 5 shows a single bolt 24" that may thread into and out of the block 7 for setting the angle of the upright assembly 11.

Figure 6:
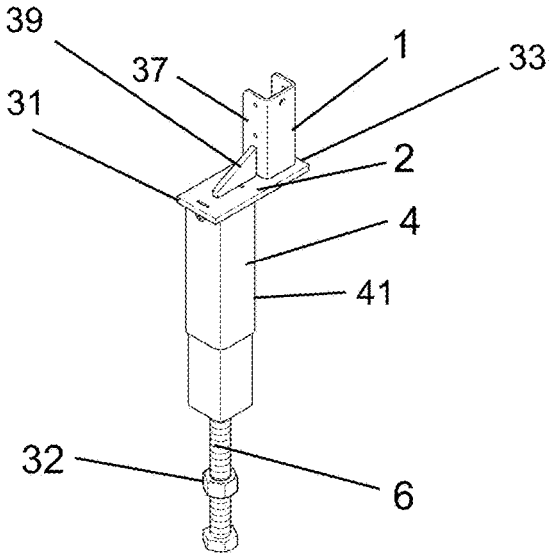
FIG. 6 is a perspective view of a portion of the leveler leg designed for supporting items at 90 degree angles from one another.
Figure 7:
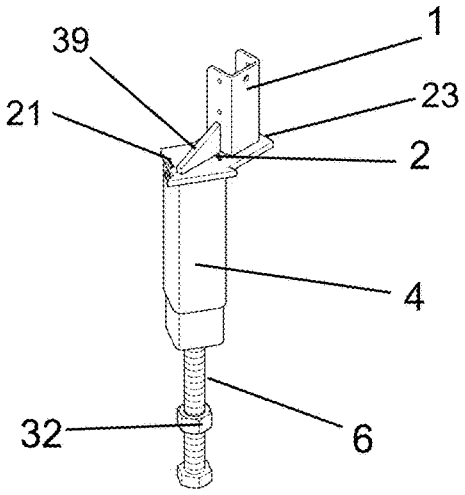
FIG. 7 is a perspective view of a portion of the leveler leg designed for supporting items at 120 degrees from one another.
Figure 8:
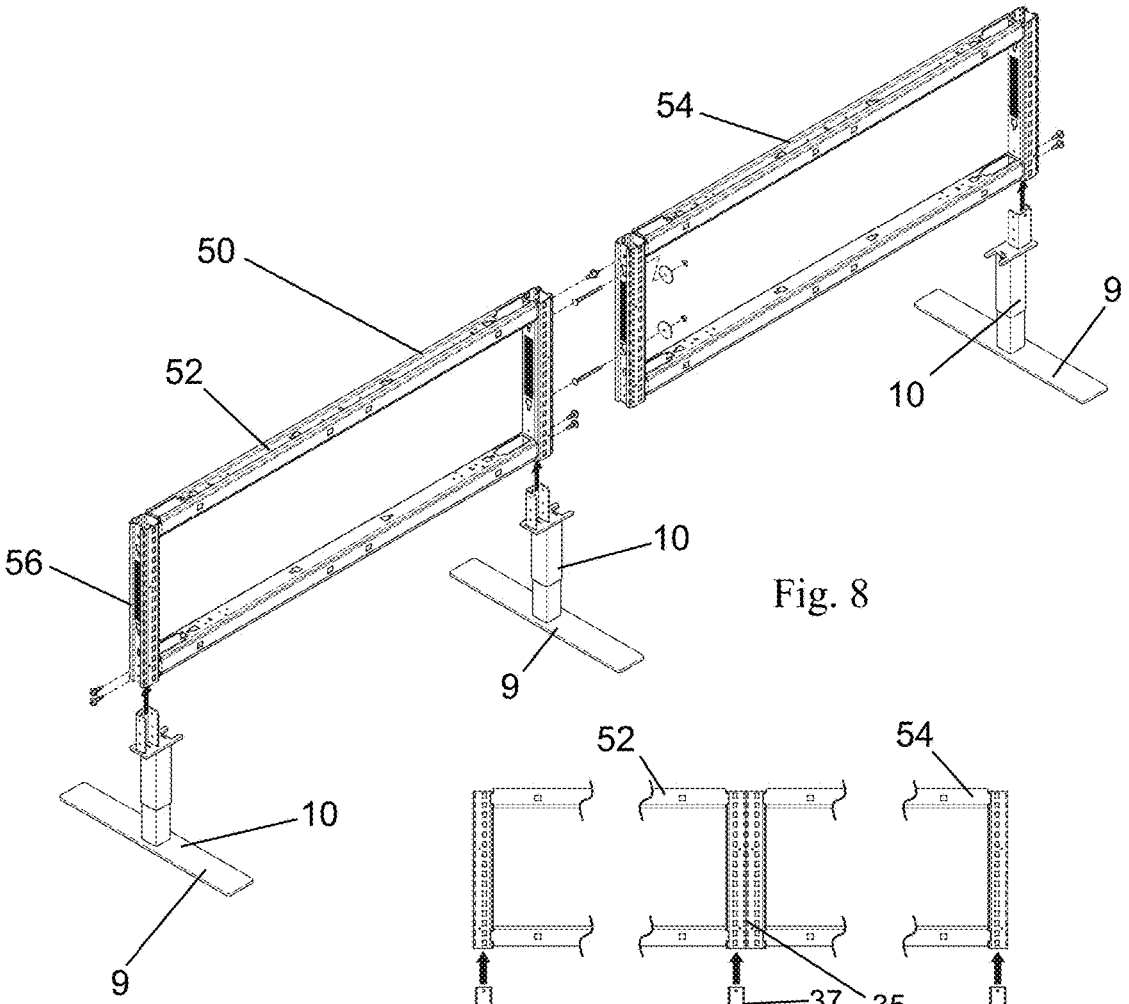
FIG. 8 is a perspective view of an embodiment with the leveler leg supporting a furniture panel in an inline arrangement.
Figure 9:
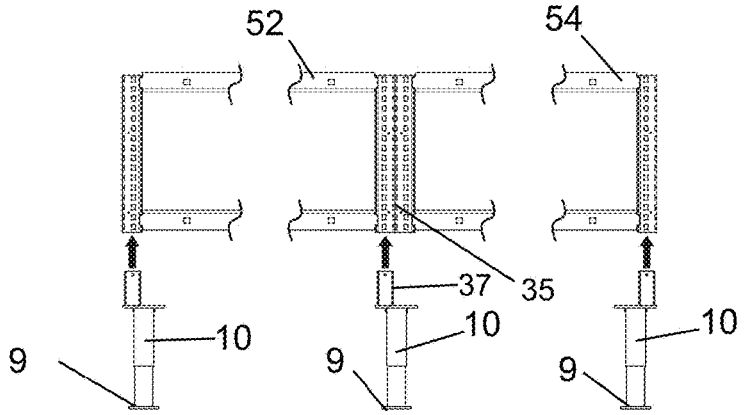
FIG. 9 is a front view thereof.
Figure 10:
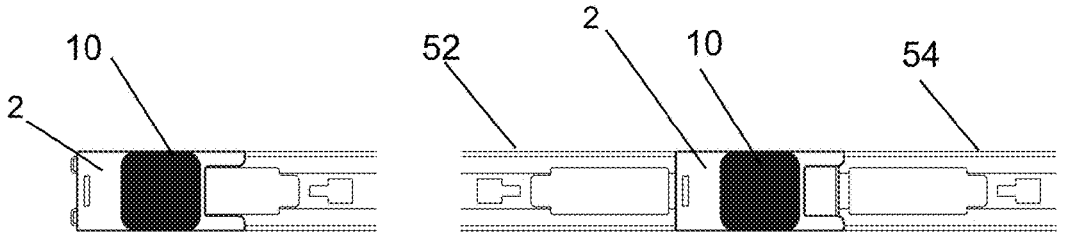
FIG. 10 is a bottom view thereof.

FIGS. 2, 6 and 7 show variations of the plate 2 and bracket 1 for use in supporting furniture panels in different configurations. For example, FIG. 2 shows a plate 2 and bracket 1 for use in inline and end of run furniture panel configurations such as those shown in FIGS. 8-10. In the FIG. 2 embodiment, the plate 2 partially offsets the bracket 1 from the upright leg 3, 4 such that an inner edge 37 of the bracket 1 is aligned under a joint 35 between then uprights 56 of adjacent furniture panels 52, 54, wherein one furniture panel 52 is attached to the bracket 1 and the other furniture panel 54 is attached directly to the furniture panel 52, enabling a single leg 10 to support both furniture panels 52, 54 in the inline configuration. In addition, this same plate 2 and bracket 1 configuration can be used in on opposing ends of the inline configuration by rotating one of the end of line legs 10 180 degrees from the other (as shown in FIG. 9). In such an inline orientation, the feet 9 of the respective leveler legs 10 are oriented at approximately a 90 degree angle to the furniture panel sections 52, 54. FIG. 10 illustrates this embodiment with the feet 9 removed for purposes of illustrating the location of the leveler legs 10.

Figure 11:
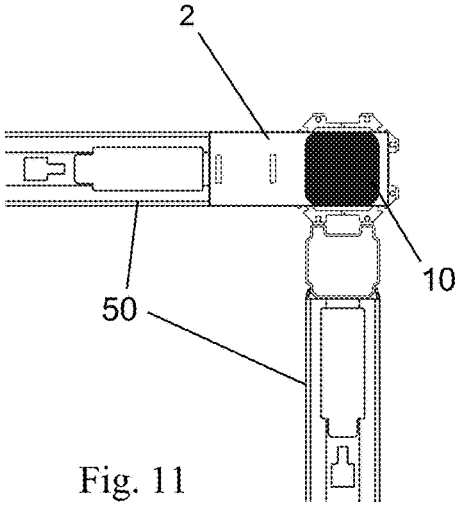
FIG. 11 is a bottom view of an embodiment with a leveler leg supporting two furniture panels in a 90 degree arrangement.
Figure 12:
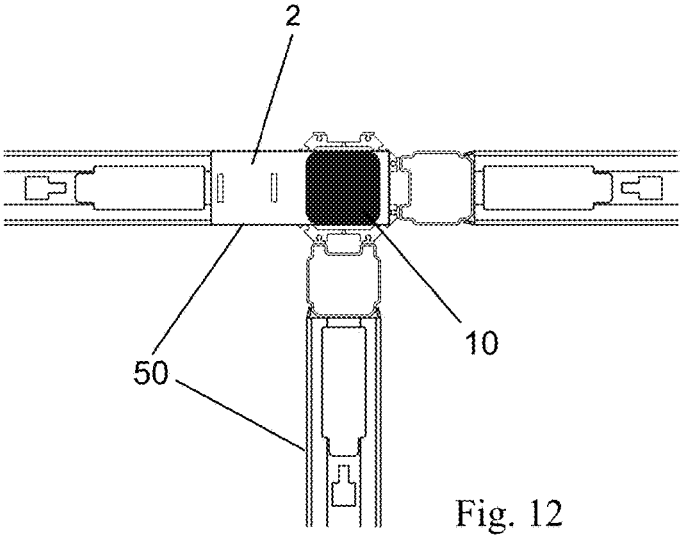
FIG. 12 is a bottom view of an embodiment with a leveler leg supporting three furniture panels in a 90 degree arrangement.
Figure 13:
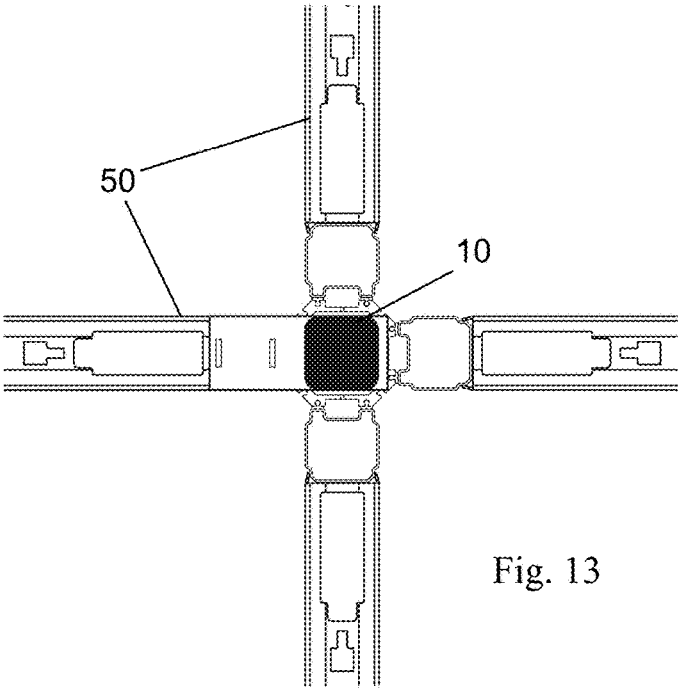
FIG. 13 is a bottom view of an embodiment with a leveler leg supporting four furniture panels in a 90 degree arrangement.
Figure 16:
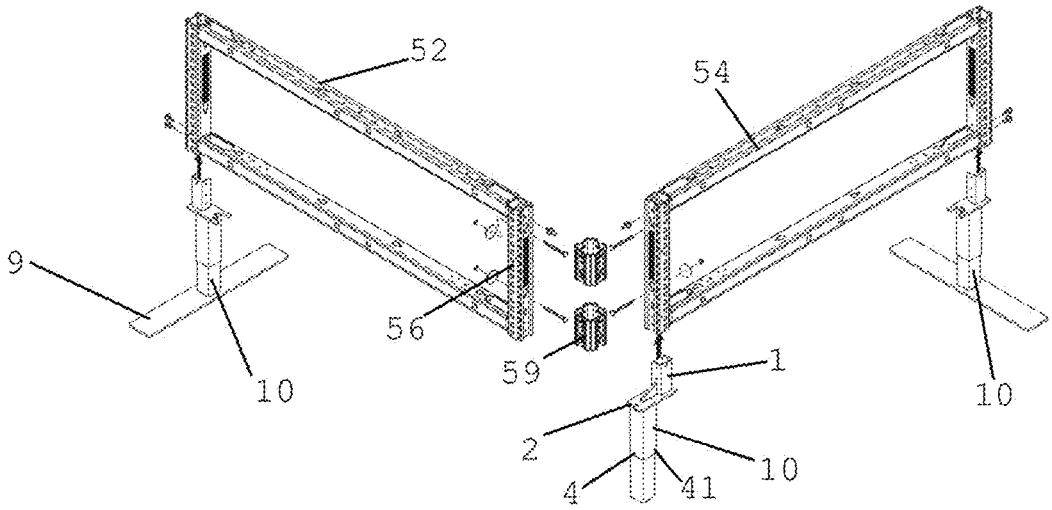
FIG. 16 is a perspective view of an embodiment with the leveler leg supporting furniture panels in an a 90 degree arrangement.

FIG. 6 shows a rear perspective view of a portion of the leveler leg 10 with the plate 2 and bracket 1 configured for attaching furniture panels at a 90 degree angle from one another such as that shown in FIGS. 11-13. In this embodiment of the plate 2 and bracket 1, the plate 2 completely offsets the bracket 1 from the upright leg 3, 4 such that an inner edge 37 of the bracket 1 is aligned generally under a side 41 of the upright leg 4, enabling a single leg 10 to support two, three or four furniture panels 52, 54 in a 90 degree configuration as shown in FIGS. 11-13 and 16 with the upright leg 3, 4 centered between the uprights 56 of the furniture panels 52, 52 and underneath the furniture panel connectors 59. To provide additional support for the bracket 1 in this embodiment with a greater offset from plate 2, the leg 10 may include a support gusset 39 extending between the plate 2 and bracket 1. As shown in FIG. 16, a leg 10 with the 90 degree embodiment is shown in the middle of the unit (illustrated with the foot 9 removed), supporting the uprights 56 of both panels 52, 54. The ends of the panels 52, 42 are supported by legs of the inline/end of run embodiment as shown in FIG. 2.

Figure 14:
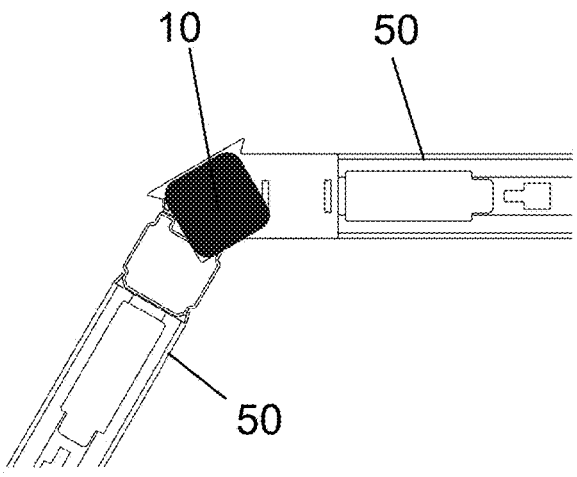
FIG. 14 is a bottom view of an embodiment with a leveler leg supporting two furniture panels in a 120 degree configuration.
Figure 15:
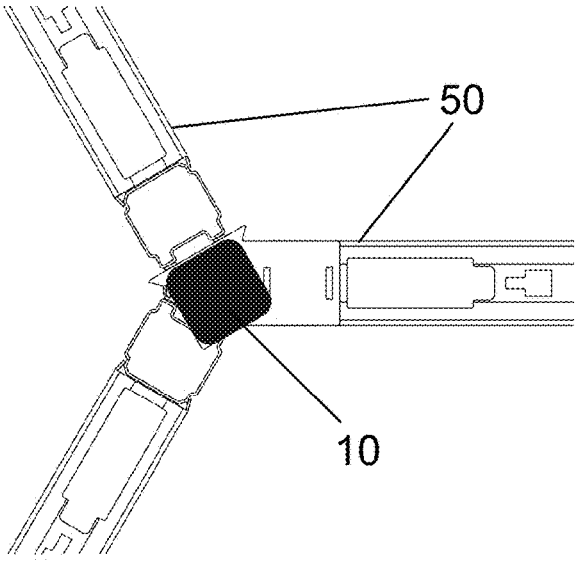
FIG. 15 is a bottom view of an embodiment with a leveler leg supporting three furniture panels in a 120 degree configuration.
Figure 17:
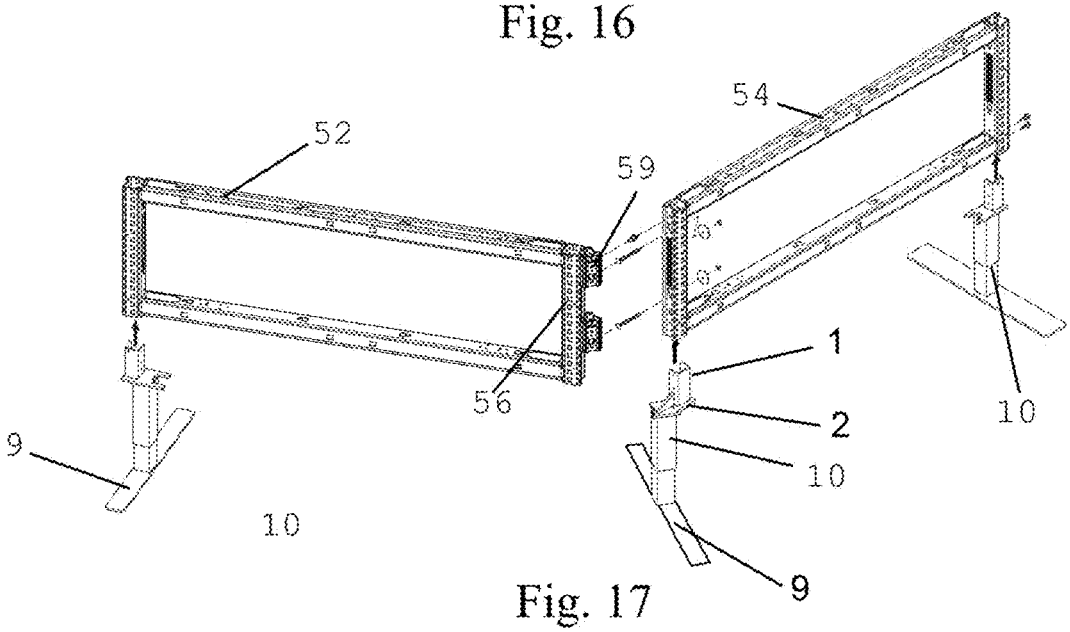
FIG. 17 is a perspective view of an embodiment with the leveler leg supporting furniture panels in a 120 degree arrangement.

FIG. 7 shows a rear perspective view of a third variation of the bracket 1 and plate 2 wherein the plate 2 provides an offset at an angle from the structural leg 3, 4 and the foot 9 for orienting items such as furniture panels at a 120 degree orientation with respect to one another. For example, in this embodiment, the plate 1 may include a first portion 21 extending in a first direction and a second portion 23 extending at about a 120 degree angle from the first portion 21. This embodiment may also provide a support gusset 39. As in the 90 degree embodiment of FIG. 6, in this FIG. 7 embodiment the bracket 1 may be completely offset from the leg 4. FIGS. 14, 15 and 17 show the leveler leg 10 of the FIG. 7 configuration supporting furniture panels 50 oriented at 120 degree angles from each other. In particular, FIG. 14 shows a 2-way connection at a 120 degree angle and FIG. 15 shows a 3-way connection at 120 degree angles. In each of these views the foot 9 of the leveler leg 10 is removed for purposes of illustrating the location of the leveler leg 10. It should be recognized that the foot 9 may be oriented in any direction with respect to the various furniture panels 50, and will generally be oriented at an angle to two of the screens 50 forming the connection. Referring now to FIG. 17, as in the inline and 90 degree configurations noted above, in the embodiment with a 120 degree configuration (shown on the middle leg 10 in FIG. 17), the offset provided by the plate 2 enables a single leveler leg 10 to support the uprights 56 of multiple furniture panels 50 with the upright 4 aligned underneath the connectors 59 extending between adjacent panel uprights 56.

The above description is that of current embodiments of the invention. Various alterations and changes can be made without departing from the spirit and broader aspects of the invention. This disclosure is presented for illustrative purposes and should not be interpreted as an exhaustive description of all embodiments of the invention. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation(s).

The embodiments of the invention in which an exclusive property or privilege is claimed are defined as follows:

1. A leveler leg comprising:

a foot, an upright leg for supporting an object such as a panel, and an upright adjustment mechanism disposed above the foot and between the foot and the upright leg to enable adjustment of the angle of the upright leg with respect to the foot, wherein the upright adjustment mechanism includes a generally horizontal pin extending through a portion of the upright leg in a first direction, such that the upright leg can pivot about the pin with respect to the foot, wherein the upright adjustment mechanism includes a tubular support extending upwardly from the foot, the tubular support defining an internal opening, and wherein a portion of the upright leg extends within the internal opening of the tubular support, and wherein the pin extends through the tubular support and the portion of the upright leg that extends within the internal opening; and a setting element extending in a second direction different from the first direction, the setting element extending through the tubular support and into engagement with the portion of the upright leg that extends within the internal opening, wherein the setting element is adjustable to set the angle of the upright leg with respect to the foot.

2. The leveler leg of claim 1 wherein a threaded rod extends upwardly from the portion of the upright leg that extends within the support, the threaded rod extending beyond the tubular support, and wherein a leg is attached to the threaded rod, the leg being height adjustable with respect to the threaded rod.

3. The leveler leg of claim 2 wherein the setting element includes one or more threaded adjustment elements extending into opposing sides of the tubular support and into engagement with opposing walls of the portion of the upright leg to enable the angle of the upright leg to be set at a desired angle for leveling the panel.

4. The leveler leg of claim 3 including a sleeve extending around the outside of the upright leg and the upright adjustment mechanism, said sleeve slidable along the leg from a first position covering the pin and threaded adjustment elements to a second position providing access to said pin and said threaded adjustment elements.

5. A leveler leg adjustment method comprising:

providing a foot having an upper surface and a lower surface;

placing the foot on a ground surface;

providing a leg extending upwardly from the foot and defining an angle between the leg and the foot, the leg having a first portion and a second portion that is height adjustable with respect to the first portion and the foot;

providing an upright adjustment mechanism connected between the leg and the foot, the upright adjustment mechanism including a tubular support and a pin about which the leg pivots with respect to the foot to change the angle between the leg and the foot, wherein the first portion of the leg is positioned within the tubular support and wherein the pin extends completely through the tubular support and the first portion of the leg;

providing at least one setting element that extends through the tubular support and engages the leg;

pivoting the leg about the pin with respect to the floor and the foot to a desired angle between the leg and the foot;

adjusting the setting element to hold the leg at the desired angle; and adjusting the height of the first leg portion with respect to the second leg portion.

6. The leveler leg adjustment method of claim 5 wherein the setting element is a set screw extending perpendicular to the pin and the step of setting the setting element includes adjusting the set screw.

7. The leveler leg of claim 6 wherein the pin extends through at least a portion of the tubular support and at least a portion of the adjustment block, the adjustment block and the leg pivoting together about the pin.

* * * * *